United States Patent [19]

Bonvallet

[11] 4,277,084

[45] Jul. 7, 1981

[54] ACCELERATION COMPENSATED STEP-IN SKI BINDINGS

[76] Inventor: Duane J. Bonvallet, 375 Becket, Brighton, Mich. 48116

[21] Appl. No.: 46,993

[22] Filed: Jun. 11, 1979

[51] Int. Cl.[3] ..... A63C 9/08

[52] U.S. Cl. ..... 280/629; 280/625; 280/630; 280/634

[58] Field of Search ..... 280/629, 630, 628, 627, 280/626, 625, 613, 634, 623, 611

[56] References Cited

U.S. PATENT DOCUMENTS

| | | | |
|---|---|---|---|
| 3,027,173 | 3/1962 | Beyl | 280/629 |
| 3,692,322 | 9/1972 | Frisch et al. | 280/629 |
| 4,129,245 | 12/1978 | Bonvallet | 280/628 |

FOREIGN PATENT DOCUMENTS

| | | | |
|---|---|---|---|
| 574661 | 3/1958 | Italy | 280/623 |

*Primary Examiner*—Randolph A. Reese
*Assistant Examiner*—Milton L. Smith
*Attorney, Agent, or Firm*—Basile, Weintraub & Hanlon

[57] ABSTRACT

An acceleration compensated step-in type ski binding for releasably securing a ski boot to a ski. The ski binding includes a pivotable body member mounted on a support plate attached to the ski which engages the boot on one side of a pivot and carries a mass on the opposite side of the pivot. The mass generates a moment equal and opposite to the moment generated by the acceleration of the boot so as to cancel out the internal forces resulting from such acceleration of the boot. The ski binding further includes a boot engagement assembly for engaging a first portion of the ski boot. The boot engagement assembly is further coupled to the support plate so as to be prevented from rotating under the influence of external forces acting on the bindings such that the boot engagement assembly translates across the ski and the fulcrum length between the contact point of the boot and the boot engagement assembly remains constant to insure the proper functioning of the acceleration compensating part of the ski binding despite the wide variety of positions at which the ski boot can engage the binding.

10 Claims, 2 Drawing Figures

ACCELERATION COMPENSATED STEP-IN SKI BINDINGS

BACKGROUND OF THE INVENTION

1. Field of the Invention

This invention relates, in general, to ski apparatus and, more specifically, to ski bindings for releasably binding ski boots to skis.

2. Description of the Prior Art

Ski bindings are designed to detachably hold a skier's boots to his ski so as to provide sufficient control of the skis; while at the same time, releasing the boot from the ski when the external forces acting upon the ski exceed a threshold value to protect the skier from serious injury.

A popular type of ski binding is the so-called "step-in" type binding in which the toe of the boot engages a pivotable toe binding assembly and the heel of the boot is releasably latched in a heel binding unit. The toe binding assembly is held against rotation by a spring-loaded mechanism which provides an adjustable force to resist rotation of the toe binding due to external forces exerted on the bindings. The toe binding assembly rotates thereby releasing the boot from the binding when the threshold force level is exceeded, which threshold force level is adjustable by changing the compression of the spring.

It has been established that, during skiing, two significant forces act upon the binding to release the boot therefrom. These forces include the external leg forces involved in directing the ski downhill which act through the boot on the binding. The other force is the internal acceleration force resulting from the acceleration of the boot mass in either the horizontal or vertical direction. Since these two forces are additive, premature release of a binding during aggressive skiing can frequently occur without a fall or the skier being in danger of injury due to the large acceleration forces acting upon the bindings. Thus, it is common to increase the spring compression in order to prevent premature binding release caused by the internal acceleration forces. However, when the skier goes through a slow, twisting-type of fall, the acceleration forces are not present and the binding tension is set too high for the leg forces alone to cause a release of the boot from the binding before the skier's leg is fractured.

Recently, a new type of ski binding has been developed which completely eliminates the internal acceleration forces acting upon the ski binding. U.S. Pat. No. 4,129,245 discloses an acceleration compensated ski boot retaining device which comprises a pivot member adapted to engage a portion of the ski boot. The pivot member is pivotally carried such that the ski boot engaging portion of the pivot member pivots on one side of the pivot plane. The device further comprises a mass having means connecting the mass to the pivot member such that the center of gravity of the mass is on the other side of the pivot plane. The mass is sized to generate a moment at the pivot plane which is equal to and opposite to the moment generated by the boot mass during lateral and/or vertical accelerations of the boot to thereby cancel out the internal acceleration forces acting against the binding.

In order for such a ski binding to function properly, it is necessary that fulcrum distance between the contact point of the boot and the pivot point of the toe binding assembly remains constant. It has been found in step-in bindings that the boot can engage the toe-cup assembly in a variety of different locations so as to make the fulcrum length between the effective acting point of the boot mass and the binding pivot point dependent upon the actual boot position. This uncertainty impairs the proper functioning of the acceleration compensated ski binding release device since the moments on each side of the pivot point would no longer be balanced.

Thus, it would be desirable to provide an acceleration compensated ski binding release device which is suitable for use with step-in type bindings. It would also be desirable to provide an acceleration compensated ski binding release device whose proper operation is not dependent upon the point that the ski boot actually engages the toe-cup assembly of the ski binding. Also it would be desirable to provide an acceleration compensated ski binding release device in which the fulcrum length between the contact point of the boot mass and the pivot point of the binding remains constant regardless of where the boot actually engages the toe-cup assembly of the binding.

SUMMARY OF THE INVENTION

Herein disclosed is a new and improved acceleration compensated step-in type ski binding for releasably securing a ski boot to a ski. The ski binding includes a body member which is pivotally mounted on a support plate attached to the ski. The body member engages a first portion of the ski boot on one side of a pivot point. The binding further includes a mass which is carried by the body member on the other side of the pivot point. The distance between the center of gravity of the mass with respect to the pivot point is adjusted to generate a moment equal and opposite to the moment generated by the acceleration of the boot mass so as to cancel out the internal forces resulting from such boot acceleration that previously have led to premature binding release.

The ski binding further includes a boot engagement assembly which is pivotally attached to the body member and which engages the first portion of the ski boot. Means are provided for preventing rotation of the boot engagement assembly such that the fulcrum distance between the contact point of the boot mass and the pivot point of the binding remains constant regardless of which position the ski boot actually engages the boot engagement assembly of the binding, which thereby insures the proper functioning of the acceleration compensated ski binding.

A ski binding constructed according to the teachings of this invention enables a step-in type of ski binding to incorporate acceleration compensated means to cancel out the internal forces caused by boot acceleration that previously have led to premature binding release. By preventing the boot engagement assembly of the ski binding from rotating during translation, the acceleration compensating means, once initially balanced, continues to function properly regardless of where the ski boot actually engages the boot engagement assembly of the binding which previously caused the fulcrum length between the contact point of the boot mass and the pivot point of the binding to change, thereby causing unbalancing of the respective moments and improper functioning of the ski binding.

BRIEF DESCRIPTION OF THE DRAWING

The various features, advantages and other uses of this invention will become more apparent by referring to the following drawing in which.

DESCRIPTION OF THE PREFERRED EMBODIMENTS

Throughout the following description, identical reference numbers refer to the same component shown in multiple figures of the drawings.

Figure 1:
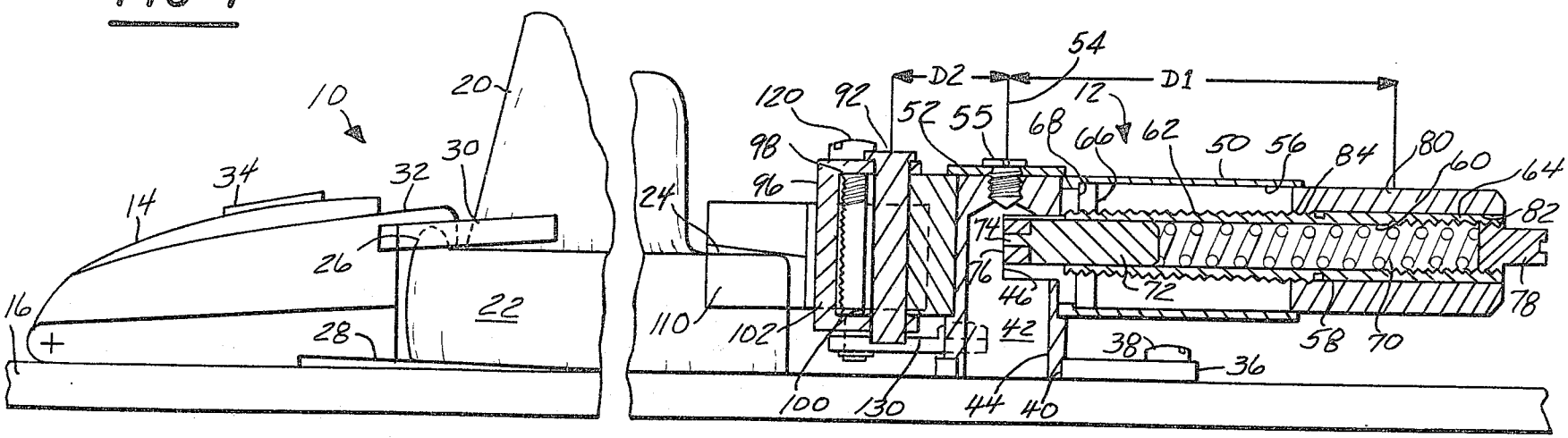
FIG. 1 is a partially sectioned view, generally taken along line 1—1 in FIG. 2, of a ski and an acceleration compensated step-in ski binding constructed according to the teachings of this invention.

Referring now to the drawing and, in particular, to FIG. 1, there is shown a ski boot retaining device or binding 10 of the so-called "step-in" type. The ski binding 10 includes a toe binding assembly 12 and a heel binding unit 14 which are mounted to the upper surface of a conventional ski 16 for the purpose of releasably securing a ski boot 20 to the ski 16. As shown therein, the ski boot 20 includes a bottom rigid portion 22 which extends along the entire length thereof. The bottom portion 22 ends in a ridge 24 along the front of the boot 20 which engages the toe-cups of the toe binding assembly 12. As described in further detail hereafter, the toe-cups straddle the sides of the toe portion of the boot 20 to hold the boot 20 on the ski. In general, the toe binding assembly 12 releases the boot 20 from the ski 16 when left or right acting horizontal forces exceed a predetermined threshold value. Although not illustrated, the toe binding assembly 12 may also be adapted to release the toe portion boot 20 in the vertical direction.

The rear portion of the rigid bottom 22 of the boot 20 is formed with an upward extending lip 26. In general, the heel binding unit 14 is spring-loaded so as to be disposed upwardly from the ski 16 when in the released position. As the boot 20 is inserted into the heel unit 14, the bottom portion of the boot 20 is centered between opposing wings 30 and engages the heel plate 28 attached to the bottom of the heel binding unit 14. The continued downward insertion of the boot 20 into the heel binding 14 causes the heel binding unit 14 to swing downward towards the ski 16 such that a latch 32 fits over the rearward lip 26 formed on the bottom portion 22 of the boot 20 thereby, in conjunction the toe binding assembly 12, firmly securing the boot 20 to the ski 16. A manual release button 34 is provided for releasing the heel binding unit 14 from the ski when desired. In general, the heel binding unit 14 releases the boot 20 from the ski 16 when vertical forces acting upon the binding exceed a predetermined level, such as during a forward fall by the skier.

This invention relates to an acceleration compensated ski binding retaining device for step-in bindings and, in particular, concerns the toe binding portion 12 of the ski binding 10 shown in FIG. 1. Although this invention describes the acceleration compensating mechanisms applied to the toe binding portion 12, it can also be effectively applied to the heel unit, or to both the toe and heel units.

The toe binding assembly 12 includes a support plate 36 which is adapted to be securely mounted to the top surface of the ski 16 by suitable fasteners, such as screws 38. The support plate 36 includes an aperture 40 wherein there is disposed a bushing 42. The bushing 42 has a substantially cylindrical shape with a bottom portion disposed in the aperture 40 in support plate 36. The bushing 42 includes a lip portion of increased diameter, the lower edge of which rests on the top surface of the support plate 36. Extending upwards from the lip portion of the bushing 42 is the top portion of the bushing 42. The bushing 42 also includes a centrally located, vertically extending internal bore or shaft 44 which extends substantially to the top of the bushing 42. Cuts are made in the bushing 42 in approximately the center thereof so as to form a pair of faces 46 on opposite sides of the bushing 42.

The toe binding assembly 12 further includes a body member 50 which is pivotally mounted about the bushing 42. The body member 50 has a substantially square cross sectional configuration and is supported on the top surface of the lip portion of the bushing 42. The body member 50 is mounted for pivotal movement about the bushing 42 by a washer 52 and a suitable fastener, such as mounting screw 55 shown in FIG. 1. The centerline of the screw 55 forms the first pivot point 54 of the toe binding assembly 12 of this invention.

The body member 50 is divided into two portions, each extending on opposite sides of the first pivot point 54. The first portion of the body member 50 includes a centrally located, length wise extending bore 56. Disposed within the bore 56 is a mass support tube 58 which is an essentially cylindrical shaft having an internal bore 60 therein. The mass support tube 58 has a plurality of external machine threads 62 on at least a portion of its peripheral surface and a plurality of an internal machine threads 64 on a portion of its internal bore 60. A cylindrical collar 66 abuts an internal lip 68 within the body member 50 at the end of the bore 56 thereby positioning the mass support tube 58 within the body member 50 of the toe binding assembly 12.

Resilient means 70, such as a coil spring, are disposed within the internal bore 60 of the mass support tube 58. The resilient means or spring 70 pushes against a spring pushrod 72 disposed at one end of the mass support tube 58. The spring pushrod 72, which has an overall diameter substantially equal to the internal diameter of the mass support tube 58, has a reduced diameter section 74 at one end thereof. A rectangular plate member 76 fits over the reduced diameter section 74 of the spring pushrod 72 and abuts or bears against the faces 46 on the center portion of the bushing 42. A spring adjuster cap 78 having external threads thereon is disposed within the opposite end of the mass support tube 58 to engage the internal threads 64 therein. The spring adjuster cap 78 provides means for increasing or decreasing the compression of the coil spring 70 in the mass support tube 58. Thus, clockwise rotation of the spring adjuster cap 78 compresses the coil spring 70 thereby increasing the compressive force acting through the spring pushrod 72 to the rectangular plate member 76 abutting the faces 46 on the bushing 42. Conversely, counterclockwise rotation of the spring adjuster cap 78 reduces the compression of the coil spring 70 thereby reducing the force acting upon the faces 46 of the bushing 42.

The toe binding assembly 12 also includes a mass 80 of substantially cylindrical cross section which is disposed within the end of the first portion of the body member 50. The mass 80 which, according to the preferred embodiment of this invention, has approximately seven ounces of mass, has a centrally located bore 82 having a plurality of internal machine threads 84 disposed adjacent one end thereof. The threads 84 engage the external threads 62 on the mass support tube 58 thereby enabling the mass 80 to be threadingly moved along the length of the mass support tube 58 so as to change the fulcrum length D1 between the first pivot point 54 and the center of the gravity of mass 80, for purposes that will become more apparent hereafter. A plurality of recesses or slots 81, as shown in FIG. 2, are provided around the peripheral surface of the mass 80 to facilitate adjustment of the mass 80 to the desired location.

Figure 2:
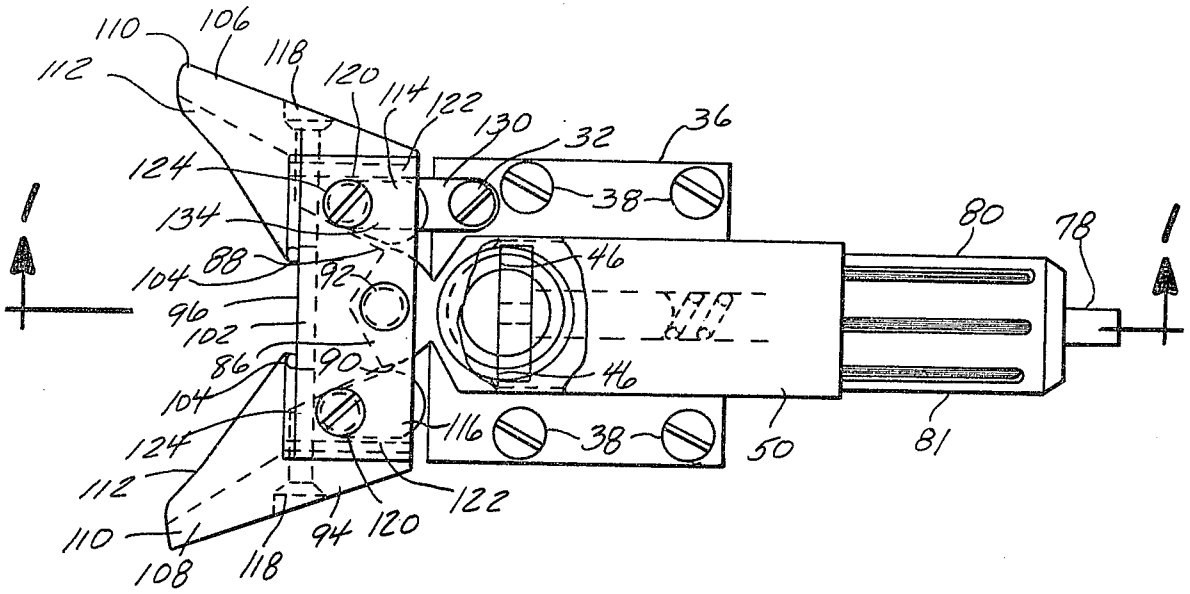
FIG. 2 is a plan view, partially broken away, of the acceleration compensated step-in ski binding illustrated in FIG. 1.

As seen in FIG. 2, the body member 50 of the toe binding assembly 12 also includes a second portion 86 which extends on the other side of the pivot point 54 from the first portion of the body member 50. The second portion 86 is formed with first and second cam surfaces 88 and 90. Connected to the second portion 86 of the body member 50 through a centering pin 92 is a boot engagement or toe-cup assembly 94. The toe-cup assembly 94 includes a bracket member 96 which is formed with top and bottom spaced flanges 98 and 100, respectively, through which the centering pin 92 extends so as to provide pivotal motion of the toe-cup assembly 94 about the centering pin 92. The pin 92 thus forms a second pivot point in the toe binding assembly 12. A vertically extending flange 102 connects the top and bottom spaced flanges 98 and 100 of the bracket member 96 and further includes stops 104 for the individual toe cups.

The toe-cup assembly 94 includes first and second toe-cup members 106 and 108, respectively, which are disposed on opposite sides of the bracket member 96. Each toe-cup member 106 and 108 includes a body portion 110 which engages the side portion of the boot 20 and a top portion 112 which abuts the ridge 24 on the bottom portion 22 of the boot 20 to thereby align the toe portion of the boot 20 with the toe binding assembly 12.

First and second wedge members 114 and 116, respectively, are connected to the first and second toe-cup members 106 and 108, respectively, by suitable fasteners 118. The wedge members 114 and 116 are formed with top and bottom spaced flange portions connected by a vertically extending edge portion. The top and bottom flange portions include aligned apertures so as to enable the wedge members 114 and 116 to be pivotally connected to the bracket member 96 by means of threaded pins 120. The threaded pins 120 permit vertical adjustment of the toe cups so as to accomodate a variety of different boot bottom portions 22. Rotation of the wedge members 114 and 116 is restrained by a cam trip mechanism including the cams 88 and 90 which are designed to release one wedge or the other after a prescribed amount of travel. A plurality of shims 122 are disposed between the sides of the wedge members 114 and 116 and the adjoining surface of the toe-cup members 106 and 108 to provide a solid fit therebetween. Also, resilient means 124, such as coil springs, are attached to the wedge members 114 and 116 and function to return the toe-cup assembly to the normal center position after the ski boot 20 has been released therefrom, as described hereafter.

The novel acceleration compensated ski binding assembly of this invention further includes means for maintaining the fulcrum length between the contact point of the mass of the toe portion of the boot and the pivot point 54 of the toe binding assembly 12 constant regardless of the exact position at which the boot 20 engages the toe-cup assembly 94 of the toe binding 12. It has been found in step-in type ski bindings that the ski boot can engage the toe-cup assembly in a variety of longitudinal positions. Such an occurrence changes the fulcrum length or distance between the contact point of the boot and the main pivot point 54 of the toe binding assembly 12 when the boot and toe-cup assembly 94 rotate about the toe binding 12. This unbalances the internal acceleration forces which were initially compensated for by an adjustment of the mass 80, as described hereafter. During the rotation of the toe binding assembly 12, under external forces acting thereon, internal acceleration forces can arise due to the above described unbalance which can lead to premature binding release.

This invention proposes to solve the above problem by maintaining the fulcrum length or distance between the effective contact point of the boot mass and the first pivot point 54 of the toe binding assembly constant through the use of means for preventing rotation of the toe cup assembly 94. In such a manner, the toe cup assembly 94 moves transversely across the width of the ski. This maintains the fulcrum length constant regardless of exactly where the ski boot 20 engages the toe cup assembly 94 of the toe binding unit 12.

According to the preferred embodiment of this invention, the means for maintaining the fulcrum length constant comprises a link or strap member 130 which is connected to support member 36 at one end 132 and to the toe-cup assembly 94 via fastener 120 at the other end 134 so as to be free to pivot about both ends 132 and 134. As can be seen more clearly in FIG. 2, the link 130 forms one side of a parallelogram; with a line drawn between the first and second pivot points 54 and 92 being the other opposed parallel side. Thus, during translation of the toe-cup assembly 94, the link 130 remains parallel to the line drawn between the first and second pivot points 54 and 92 and thereby prevents rotation of the toe cup assembly 94 with respect to the ski and causes the toe cup assembly 94, to move transversely along an arc. The use of the parallel link 130 also minimizes the amount of mass 80 required to balance the internal acceleration forces of the ski binding 10 by permitting D2 to be short which further results in minimizing the distance required for the toe-cup assembly 94 to move before releasing the boot 20 therefrom. Although a link 130 is illustrated and described for preventing rotation of the toe-cup assembly 94, other means for preventing such rotational movement and causing transverse movement, such as a guide track and cam, could also be used to practice the teachings of this invention.

In use, prior to beginning skiing, the skier inserts the toe portion of the ski boot 20 into the toe binding assembly 12 to engage the toe cups 106 and 108. The skier then exerts a downward force on the rear portion of the ski boot 20 until the heel binding 14 latches over the rearward lip 26 of the ski boot thereby firmly securing the ski boot 20 to the ski 12.

As mentioned previously, the two significant forces acting upon a ski binding during skiing are the external forces imposed by the skier's leg and the internal forces generated by the acceleration of the boot mass. The skier must adjust his bindings by increasing the amount of compression on the spring 70 so as to prevent their inadvertant release which may occur due to the simultaneous action of the internal and external forces on the bindings. As aforementioned, this combined force results in the skier having to adjust his bindings with a release force which may be sufficient to cause a fracture of the leg in the event of a non-violent fall where the internal acceleration forces do not develop and the ski boots do not separate from the ski bindings. These internal acceleration forces are cancelled by positioning the mass 80 such that its center of gravity is a predetermined distance or fulcrum length D1 from the pivot point 54 of the toe binding assembly 12 so as to generate a moment that is equal to and opposite to the moment generated by the acceleration of the mass of the toe portion of the boot which acts through the pivot point 92, which is at a fulcrum length or distance D2 from the pivot point 54 of the binding 12. When the product of mass 80 times the distance D1 equals the mass of the boot toe portion times distance D2, the internal acceleration forces are balanced and the only forces acting to release the bindings are the external leg forces. Thus, the binding may be safely adjusted to release at external force levels less than that that could cause a fracture of the skier's leg without experiencing the premature release due to shock loads caused by acceleration of the boot mass.

Since the internal acceleration forces are cancelled, the skier can preload the spring 70 with the compressive force appropriate for the style of skiing he intends to perform without the fear of inadvertant binding release due to the acceleration forces. The spring 70 applies force on the pushrod 72 and forces the plate member 76 attached thereto against the faces 46 of the bushing 42. This resists rotation of the body member 50 under the influence of horizontal forces acting upon the binding since the body member 50 can rotate about the fixed bushing 42. When the force exerted on the ski boot and the toe-cup assembly exceeds the preset compression force, the body member 50 will rotate until one of the wedge members 114 and 116 slips past its corresponding cam surface 88 or 90 respectively, on the second portion of the body member 50 which releases the boot 20 from the toe binding assembly 12. Once the ski boot 20 is completely released from the binding, the coil springs 124 return the toe-cup assembly to the normal centered position.

During the movement of the toe binding assembly, as described above, the parallel link 130 causes the bracket member 96 and the toe-cup assembly 12 to translate across the ski in an arc without rotating as is normal in conventional step-in bindings. This maintains the fulcrum length between the contact point of the boot mass 92 and the pivot point 54 of the toe binding assembly 12 constant regardless of the exact position at which the boot 20 engages the toe-cup assembly which thereby eliminates the uncertainty in the balancing of the internal acceleration forces.

In summary, there has been disclosed herein, a new and improved acceleration compensated step-in type of ski binding. By providing a mass on the opposite side of a pivot point from the portion of the binding which engages the toe of a ski boot that produces a moment equal to and opposite to the moment generated by the boot acceleration forces, such acceleration forces are cancelled which allows the ski binding tension to be reduced to a level sufficient to protect the skier from serious leg injury in all types of skiing conditions. Further, the acceleration compensation feature of the ski binding is maintained in a balanced condition despite the exact position at which the toe portion of the ski boot actually engages the toe binding assembly. Means are provided for preventing rotation of the toe binding such that the toe cup assembly translates across the ski which insures that the internal boot acceleration forces are always balanced despite the wide variety of positions at which the ski boot can engage the toe binding assembly.

What is claimed is:

1. An acceleration compensated ski boot release device for a safety ski binding comprising:

a support member adapted to be fixably mounted to a ski;

a body member pivotally carried by said support member for movement about a first pivot point;

means, carried by said body member, for releasably connecting a first portion of said boot to said body member;

means for maintaining the fulcrum length between the effective acting point of the mass of said boot and said first pivot point constant regardless of where said first portion of said boot engages said boot connecting means;

a mass; and means, for connecting said mass to said body member such that said mass and said body member pivot together as a unit about said first pivot point and the center of gravity of said mass is disposed on the opposite side of said first pivot point from the mass of said boot to generate a moment at said first pivot point equal and opposite to the moment generated by said boot mass during acceleration of said boot to cancel the internal acceleration forces generated by said boot mass.

2. The ski boot release device of claim 1 wherein the means for maintaining the fulcrum length constant includes means for preventing rotation of the first boot connecting means.

3. The ski boot release device of claim 2 wherein the rotation preventing means includes a link connected between the support member and the first boot connecting means in parallel with a line drawn between the first pivot point and the point at which the first boot connecting means is attached to said body member.

4. The ski boot release device of claim 3 wherein the boot connecting means includes;

a bracket, said bracket being pivotally connected at a second pivot point to the body member for movement thereabout; and a boot engagement member rigidly connected to said bracket member for movement about a second pivot point, said boot engagement member being adapted to engage the first portion of the ski boot.

5. The ski boot release device of claim 1 wherein the means for maintaining the fulcrum length constant includes means for causing the first boot connecting means to substantially translate with respect to the ski.

6. The ski boot release device of claim 1 further including means for varying distance between the center of gravity of the mass and the first pivot point so as to vary the magnitude of the moment generated at said first pivot point by said mass.

7. The ski boot release device of claim 6 further including resilient means for providing a resilient force to the body member that opposes rotation of said body member about the first pivot point.

8. The ski boot release device of claim 7 wherein the resilient means is a spring carried by the body member and acting at the first pivot point and wherein said ski boot release device further includes means for adjusting the compression of said spring so as to vary the amount of force that opposes rotation of said body member about first pivot point.

9. An acceleration compensated ski boot release device for a safety ski binding comprising:

a support member adapted to be fixably mounted to a ski;

a body member pivotally carried by said support member for movement about a first pivot point;

means, carried by said body member, for releasably connecting a first portion of said boot to said body member;

means for maintaining the fulcrum length between the effective acting point of the mass of said boot and said first pivot point constant regardless of where said first portion of said boot engages said boot connecting means;

a mass;

means, for connecting said mass to said body member such that said mass and said body member pivot together as a unit about said first pivot point and the center of gravity of said mass is disposed on the opposite side of said first pivot point from the mass of said boot to generate a moment at said first pivot point equal and opposite to the moment generated by said boot mass during acceleration of said boot to cancel the internal acceleration forces generated by said boot mass; and means for varying the distance between the center of gravity of said mass and said first pivot point so as to vary the magnitude of the moment generated at said first pivot point by said mass; said varying means comprising:

said body member having a centrally disposed internal bore;

a mass support tube supported in said internal bore, said mass support tube having a plurality of external threads on at least a portion of its periphery;

said mass having an internal bore;

said mass having a plurality of internal threads on said internal bore for engaging said external threads on said mass support tube such that the location of said mass with respect to said first pivot point of said ski binding release device may be threadingly varied.

10. An acceleration compensated ski boot release device for a safety ski binding comprising:

a support member adapted to be fixably mounted to a ski;

a body member pivotally carried by said support member for movement about a first pivot point;

a mass support tube carried by said body member, said mass support tube having a plurality of external threads on at least a portion of its periphery;

a spring disposed within said mass support tube and acting at said first pivot point to provide a resilient force that opposes rotation of said body member about said first pivot point;

a mass, said mass having an internal bore with a plurality of threads thereon, said mass being disposed on said mass support tube such that said mass and said body member pivot together as a unit about the first pivot point and the center of gravity of said mass is disposed on the opposite side of said first pivot point from said boot mass to generate a moment at said first pivot point equal and opposite to the moment generated by said boot mass during the acceleration of said boot mass to cancel the internal acceleration forces generated by said boot mass, said internal threads on said mass engaging said external threads on said mass support tube such that said mass is moveable along the length of said mass support tube so as to vary the distance between the center of gravity of said mass and said first pivot point and thereby vary the magnitude of the moment generated by said mass at said first pivot point;

means, for releasably connecting a first portion of said boot to said body member, said toe portion connecting means comprising; and means adapted to be mounted on said ski, for releasably attaching a second portion of said boot to said ski;

a bracket member connected to said body member for rotation about a second pivot point;

a boot engagement assembly pivotally connected to said bracket member and restrained from rotation by means of a cam trip mechanism and adapted to engage said first portion of said ski boot; and a link connected between said support member on one end and said bracket member on the other end and disposed in a parallel with a line drawn between said first and second pivot points so as to prevent rotation of said first boot connecting means and thereby maintain the fulcrum length between the contact point of the boot and said first pivot point constant for whatever location said ski boot engages said first boot connecting means.

* * * * *